US008958131B2

(12) United States Patent
Northup et al.

(10) Patent No.: US 8,958,131 B2
(45) Date of Patent: Feb. 17, 2015

(54) SYSTEMS AND METHODS FOR THE PRINTING OF PRE-CONSTRUCTED CLOTHING ARTICLES AND CLOTHING ARTICLE SO PRINTED

(76) Inventors: Sydney Northup, Mt. Pleasant, SC (US); Joseph Werner, II, St. Louis, MO (US)

( * ) Notice: Subject to any disclaimer, the term of this patent is extended or adjusted under 35 U.S.C. 154(b) by 622 days.

(21) Appl. No.: 11/833,692

(22) Filed: Aug. 3, 2007

(65) Prior Publication Data

US 2009/0034012 A1 Feb. 5, 2009

(51) Int. Cl.

| | |
|---|---|
| ***B41C 1/02*** | (2006.01) |
| ***A41D 1/00*** | (2006.01) |
| ***B41M 5/025*** | (2006.01) |
| ***B41M 5/035*** | (2006.01) |
| ***D06P 5/28*** | (2006.01) |
| ***A41B 1/00*** | (2006.01) |
| ***A41D 1/06*** | (2006.01) |
| ***A42B 1/00*** | (2006.01) |
| *B05C 17/08* | (2006.01) |

(52) U.S. Cl.

CPC ..... *A41D 1/00* (2013.01); *B41M 5/0256* (2013.01); *B41M 5/035* (2013.01); *D06P 5/004* (2013.01); *A41B 1/00* (2013.01); *A41D 1/06* (2013.01); *A42B 1/004* (2013.01)

USPC ..... 358/3.29; 358/3.3; 358/1.15; 347/104; 382/305; 101/483; 101/126

(58) Field of Classification Search

USPC ..... 358/3.29, 3.3; 347/104; 705/1

See application file for complete search history.

(56) References Cited

U.S. PATENT DOCUMENTS

| | | | | |
|---|---|---|---|---|
| 6,811,840 | B1 | 11/2004 | Cross | |
| 6,908,190 | B2 * | 6/2005 | Iwatsuki et al. | 347/104 |
| 7,216,068 | B2 | 5/2007 | Li et al. | |
| 7,311,041 | B2 * | 12/2007 | Niimi | 101/114 |
| 2005/0240416 | A1 * | 10/2005 | Schindler et al. | 705/1 |
| 2007/0061980 | A1 | 3/2007 | Craamer | |
| 2007/0198118 | A1 * | 8/2007 | Lind | 700/138 |
| 2008/0241487 | A1 * | 10/2008 | Tomes et al. | 428/195.1 |

FOREIGN PATENT DOCUMENTS

| | | | |
|---|---|---|---|
| JP | 2004238783 | A | 8/2004 |
| WO | 03/046274 | A2 | 6/2003 |

OTHER PUBLICATIONS

International Search Report, International Patent Application No. PCT/US08/72059, mailed on Dec. 29, 2008, 10 pages.

* cited by examiner

*Primary Examiner* — Quang N Vo

(74) *Attorney, Agent, or Firm* — Lewis, Rice & Fingersh, L.C.

(57) ABSTRACT

A system and method which allows for a pre-constructed article of clothing to having printing on substantially all of its external surface area. Specifically, an image may be simultaneously printed across multiple components of a clothing article. The method generally provides for transfer of a digital image, such as a digital photograph, to be applied to an article of clothing in a manner that prints an entire two-dimensional surface of the clothing with a coherent image, that maintains coherency when the article of clothing is worn. There is also provided an article of clothing produced using the systems and methods.

19 Claims, 7 Drawing Sheets

SYSTEMS AND METHODS FOR THE PRINTING OF PRE-CONSTRUCTED CLOTHING ARTICLES AND CLOTHING ARTICLE SO PRINTED

BACKGROUND

1. Field of the Invention

The present invention relates to a system and method for the printing of pre-constructed clothing articles, and clothing articles so printed.

2. Description of the Related Art

The customization of pre-constructed clothing articles is relatively common. Because of the advent of centralized manufacture, the vast majority of individuals now wear clothing which is mass produced to standardized sizes in standardized patterns as opposed to being individually constructed for their person. While many will seek out tailoring, which is designed to improve the fit or wear of such pre-constructed clothing articles, many other people are interested in customizing pre-constructed clothing to provide for a unique appearance. This customization may be to provide for a look unique to the individual, or to provide for a relatively small number of identical pieces of clothing, such as for a club, team, school, business or other group of people interested in wearing matching clothing to show an allegiance, a participation in a particular event or activity, or to provide a quick indicator of association. The customization is usually done because the individual wants to express a relatively unique style specific to the individual or group. For example, a person may be interested in having their family, or pet, pictured on an article of clothing, but would be uninterested in having someone else's family or pet.

Customization generally involves the transfer of a two-dimensional image, selected by the person customizing the clothing, from an image that is not on clothing to the clothing. The person wishing to obtain the piece will therefore generally carry out two steps. The individual will select a two-dimensional image that they wish to have printed on the article of clothing and the pre-constructed article of clothing (both style and size) that they wish it printed on. While there are certain images prepared for use on clothing and many custom printing techniques are also used for mass production, customization is intended, herein, to mean transfer of an image which has either been custom created by the individual for use on the clothing, or is an image taken from elsewhere which the user wishes to have transferred to the clothing after the clothing article is constructed.

While custom clothing can be constructed by the customization of raw cloth or construction techniques, the customization of pre-constructed clothing presumes that the clothing article has already been manufactured and is ready to wear prior to being printed. The appearance is therefore altered after construction to provide for the customization.

The vast majority of customization occurs on shirts and specifically on T-shirts. The T-shirt, because of its large front and rear panels and easy visibility when worn provides for an excellent surface on which to print an image. Further, we have become used to seeing T-shirts with writing and other images which are designed to attract attention and proclaim the user's desired statement.

One common method for customization is embroidery. This method, while producing rugged and generally attractive clothing, is quite labor intensive and limited in reproducing actual images. These type of systems are instead limited to being generally solid color designs defined by available threads. While a wide variety of colors can be used, the human eye is often accepted as being able to distinguish more than 15 million different colors. As embroidery systems utilizing such monstrous numbers of colors would be impossibly complex, the patterns are generally limited by the colors of thread or other fabric available. Further, each thread sewn is generally of relatively large size, and therefore it is often difficult to create other resultant colors through dithering and related techniques. Therefore, embroidered designs often have a distinct unnatural look. The advent of high speed computer controlled embroidery machines has made the embroidery process capable of reproducing more complex designs, but embroidery still requires significant time for a custom print and is generally limited to small more stylized images (such as those on pockets or smaller articles such as hats). Further, embroidery generally makes the resultant article relatively stiff and much thicker in consistency further limiting its ability to be used on large areas and on clothing which needs to flex when worn.

The advent of screen printing or silk screening technology allowed for alternatives for placement of custom images on clothing. Screen printing effectively uses a stencil to allow a pattern of ink to print onto an underlying surface, such as a piece of clothing. Such methods usually use inks that provide for a hard-edged image. Since the screen or stencil, with modern manufacturing processes, can be made very detailed, it is also possible to print relatively full color using Cyan-Magenta-Yellow ink combinations for virtually any image that could be provided.

Screen printing, while a major improvement in imaging on pre-constructed clothing, still has problems. Because of the nature of a silk screen application, each screen could only be used to apply a single color of printing in a single pattern therefore requiring full color designs to use at least three screens, and possible additional ones to produce specialized colors such as metallics or white. Further, because the article had to be printed multiple times, registration problems (where one color moves slightly relative to others) could ruin the resultant article. Further, screen printing inks generally render the underlying fabric stiff because they print on the surface of the fabric. This also allows them to wear off over time. For these reasons, while the cost of a single color screen printed design may be quite reasonable, a multiple color design was often prohibitively expensive without being combined in a large order and even then screen printing is generally unable to produce true full color designs.

Newer technologies, such as dye sublimation and ink jet printing of clothing have provided vast improvements in the ability to provide for multiple colors and the reproduction of more complicated images without loss of as much detail in reproduction. These technologies can allow for complex, many color images, such as high detail photographs to be reproduced at reasonable cost.

While the technology for printing higher quality images has gone up, one facet of clothing article printing that has remained in the same is the area of the clothing article that is printed. Because of the nature of printing techniques, in order to print a surface of a clothing article, the surface generally must be flattened because all the techniques will print on the two-dimensional surface presented to the transfer technology. In order to make sure the surface is flat, the selected images are purposefully made smaller than the individual component of the clothing unto which they are to be printed so that the area to be printed can be completely and easily smoothed out rendering a clean print. Effectively, prior methods have therefore only printed on a single component of an article of clothing at any time, as each component comprises a relatively thin piece of fabric lending itself well to two-dimensional image transfer. For example, printing on the front of a T-shirt means printing only on the front panel of the torso. Further, because images are often printed on a number of different clothing articles of different size and design without the image changing, the image is almost universally centered on that component. In that way, differences between clothing articles need not be taken into account during the printing process and the image can be printed on different sized articles. However, this can result in a relatively small customization space and an article of clothing which often looks distinctly "homemade" because the image retains qualities of its pre-clothing appearance. For example, the printing of a photograph prints the photo in its standard rectangular shape, clearly showing it is simply a photograph printed on a shirt.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other reasons known to those of ordinary skill in the art, disclosed herein, among other things, are systems and methods for custom printing in an all-over fashion an article of pre-constructed clothing and an article of pre-constructed clothing so printed. Specifically, in all-over printing the image carries over between components of the pre-constructed article of clothing so as to cover a two-dimensional surface of the article. These systems and methods generally provide for an article of clothing which includes a custom image, but does so in manner that makes the clothing appear as a cohesive whole as if assembled around the image, instead of the image being printed post-construction of the article.

Described herein, among other things, is a method of printing a pre-constructed article of clothing, the method comprising; providing a pre-constructed article of clothing comprising at least two components; providing a digital image to be placed on said article of clothing; forming a computer template, the template being proportioned to be the same size and shape as the article of clothing in a particular arrangement of its components; having a jig, the jig being capable of holding the article of clothing in a particular arrangement where the article has a two-dimensional surface shaped similarly to and proportional to said computer template; arranging at least a portion of the digital image so as to completely cover the computer template; using the computer template to generate a print master; mounting said article of clothing on said jig; and using said print master to transfer said image to said article of clothing; wherein, said portion of said digital image extends across at least two of said at least two components.

In an embodiment of the method, the article is a shirt, hat, pants, or shorts. In an embodiment of the method, the using comprises performing dye sublimation.

In an embodiment of the method, the method further comprises aligning said jig with said print master which may occur automatically.

There is also described herein a method of printing a pre-constructed article of clothing, the method comprising; providing a pre-constructed article of clothing on which a two-dimensional surface is defined; providing a digital image to be placed on said two-dimensional surface; forming a computer template, the template being proportioned to be the same size and shape as said two-dimensional surface; arranging said article of clothing so as to present said two-dimensional surface; formatting at least a portion of the digital image so as to completely cover the computer template, said portion defining a coherent image; and transferring said image to said two-dimensional surface in such a fashion that said coherent image retains its coherency when said article of clothing is worn.

In an embodiment of the method, the article is a shirt, hat, pants, or shorts. In an embodiment of the method, the using comprises performing dye sublimation.

In another embodiment of the method, said coherency is obtained when said article of clothing is folded in accordance with a current style of wearing such article of clothing.

Another embodiment of the method further comprises aligning said two-dimensional surface with said print master, which may occur automatically.

There is also described herein a printed pre-constructed article of clothing comprising: a pre-constructed article of clothing having at least two components and having a two-dimensional surface defined thereon; and an image, printed on said two-dimensional surface in such manner that said image carries across at least two of said at least two components.

In an embodiment of the article, said image comprises a portion of a digital image which may be a digital photograph.

In an embodiment of the article, the article is a shirt, hat, pants, or shorts.

DESCRIPTION OF THE PREFERRED EMBODIMENT(S)

Figure 1:
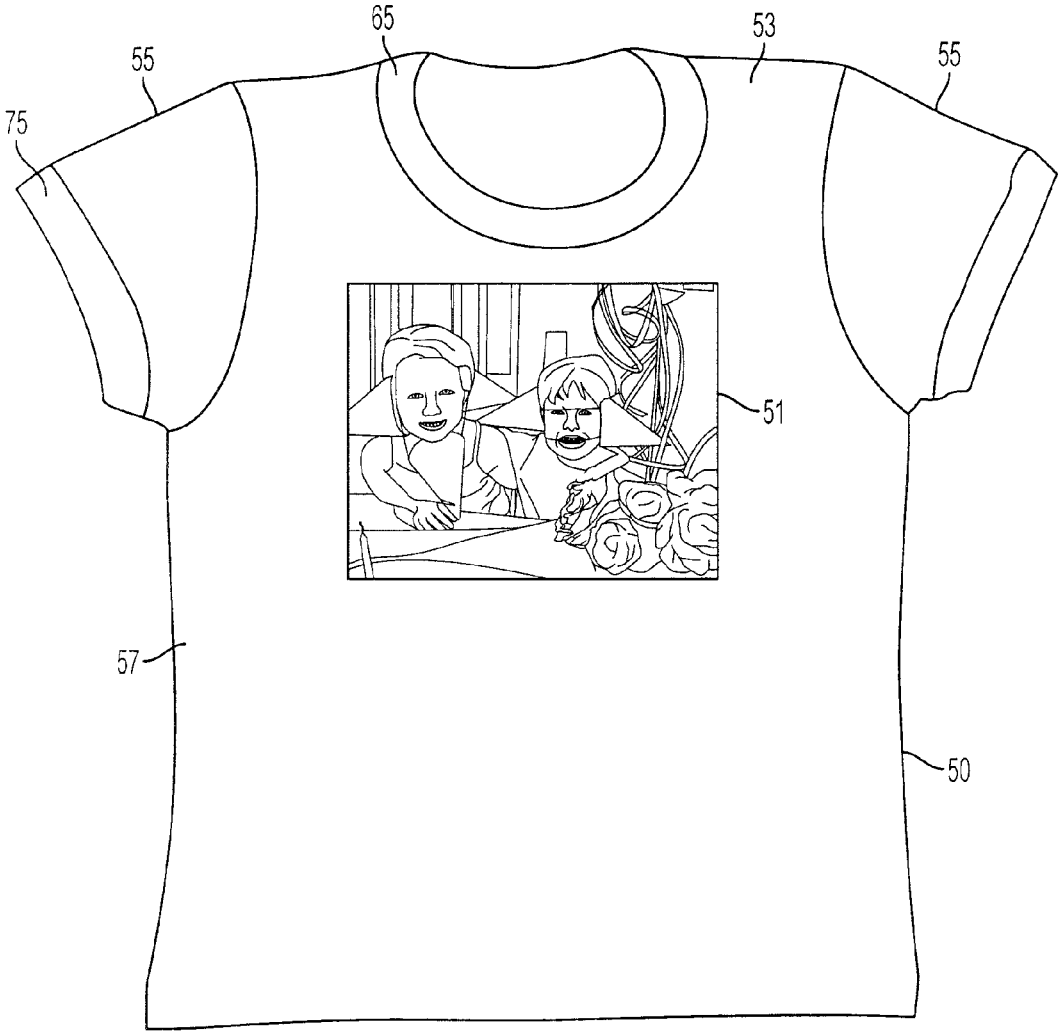
FIG. 1 PRIOR ART
FIG. 1 shows a front view of a printed T-shirt of the prior art showing a centralized printed area.

The following detailed description illustrates by way of example and not by way of limitation. Described herein, among other things, are embodiments of pre-constructed articles of clothing which can be custom printed in an all-over fashion. Specifically, all-over printing relates to printing where more than one component of the article of clothing is printed simultaneously. While this discussion will focus on the printing of shirts and specifically T-shirts because that is the most commonly printed pie-constructed article of clothing, one of ordinary skill in the art would recognize that the systems and methods discussed herein can be used for any pre-constructed article of clothing.

A pre-constructed article of clothing, as contemplated herein, is any article which is already manufactured and ready to wear prior to the image with which the article is to be printed is placed thereon. That is, while this application contemplates the printing of fabric, the process of printing on a pre-constructed article of clothing requires that the fabric already be cut and assembled into an article of clothing prior to the printing taking place.

This disclosure will also discuss what is termed "all-over printing" which is accomplished in an embodiment. This printing does not require that every portion of the exterior surface of an article of clothing include printed parts of the image, and certain embodiments utilize various places where the images is not present. Instead, the concept of "all-over printing" is generally intended to indicate that a coherent image presented on the article of clothing covers a selected two-dimensional surface area across multiple components of the article of clothing which are printed simultaneously. To try and explain this concept, virtually all articles of clothing can be placed so as to have a flat surface. E.g. a wadded up article thrown on the floor has such a surface in contact with the floor. The all-over printing discussed herein is designed to print such a two-dimensional surface in its entirety but does so in such a way that when a coherent image is placed on the surface in a single print process, the coherency of the image is maintained while the article is worn. Further, in an embodiment, unprinted areas of an all-over print effectively become part of the image adding to uniqueness, instead of appearing as borders or unprinted areas. All-over printing may be limited to one surface of an article (e.g. printing the front side of the article for example) or may be across multiple sides (e.g. essentially printing which covers all surfaces front and rear). Regardless of which type of printing is discussed, the image would generally carry across more than one component of the clothing.

A component of clothing refers to the fact that a pre-constructed clothing article is rarely a single piece but is instead made from a number of pieces sewn together. If the pre-constructed article comprises a shirt, for example, the components can comprise, and the printing may extend across, any or all of the main panel (such as the front and back torso of the shirt) as well as secondary panels (such as arms), sub-components (such as pockets, collars, or cuffs if present), and even details (such as buttons or hems). This printing of the image across multiple components simultaneously also provides for all-over printing. Literally, in all-over printing, the printed surface is the entire two-dimensional surface of the article presented the printing technology by the positioning of the article.

Traditional printing of pre-constructed articles of clothing has presented a number of limitations. Firstly, the printed area generally had to be centered on an individual component of the clothing to ensure that coherency of the image is maintained. While virtually any component could be printed, the surface had to be individually defined so an image could be printed on the front, back, arm, leg, pocket or other component individually. If multiple components were to be printed, they were printed individually or sequentially (for example, the front of the torso and then an arm would be printed). Further, the image was generally centered on the component on which it was printed.

FIG. 1 provides a drawing of a printed pre-constructed shirt of the prior art. The shirt (50) includes an image (51), the same image as FIG. 3, which is generally centered on the front panel (53) of the shirt (50). The arms (55) and other components like the collar (65) and cuffs (75) include none of the image (51) and the image (51) is bordered by a border portion (57) formed from unprinted fabric of the front panel (53). The image (51) may also include unprinted sections within the image itself to provide for sections where the original color of the shirt is used to provide a particular color in the image. This shirt (50) therefore has a coherent image printed thereon, but the image is not coherent across multiple components and the entire defined two-dimensional surface (which is effectively the sheet of the drawing).

Figure 2A:
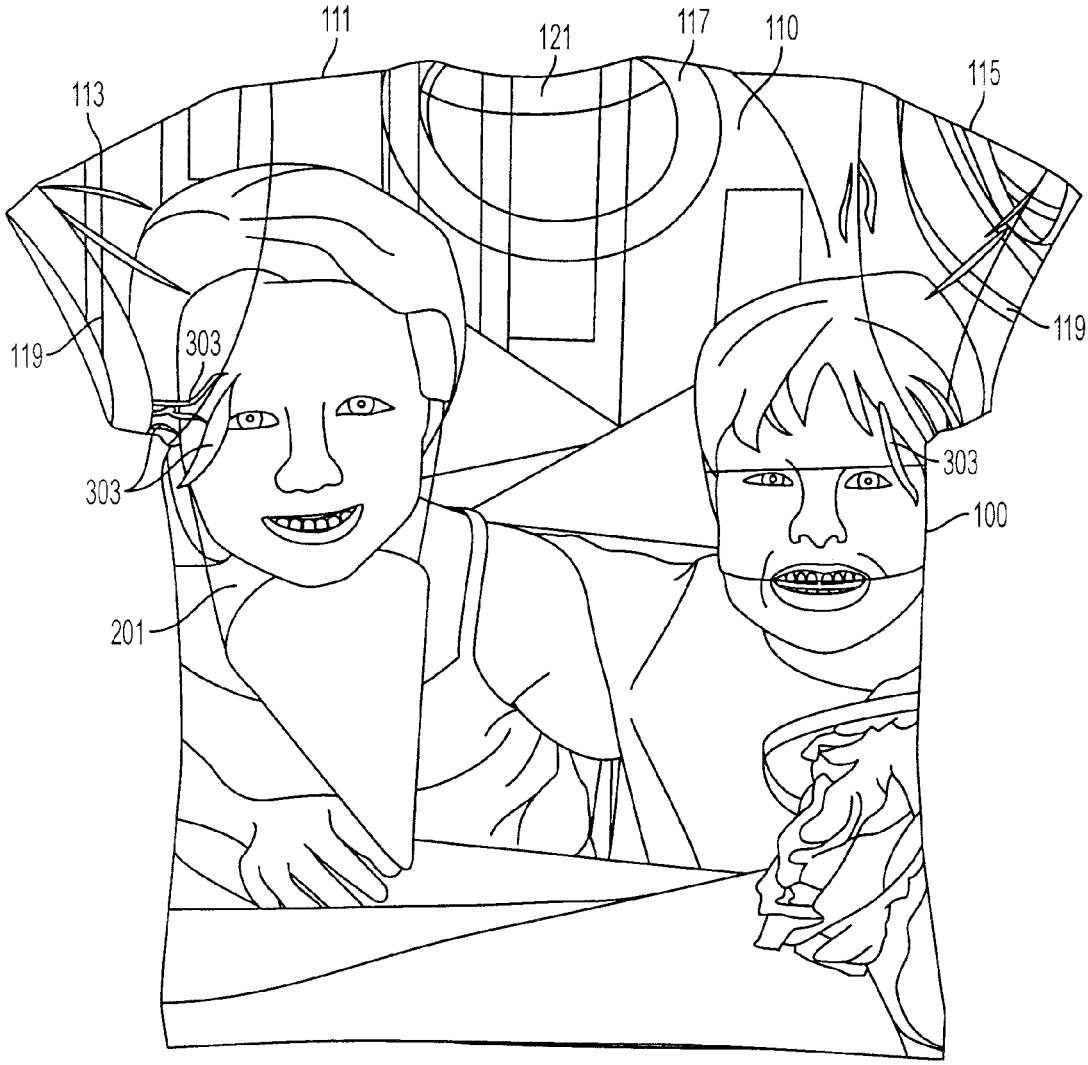
FIG. 2A is a front view of a T-shirt including an all-over print on the front.
Figure 2B:
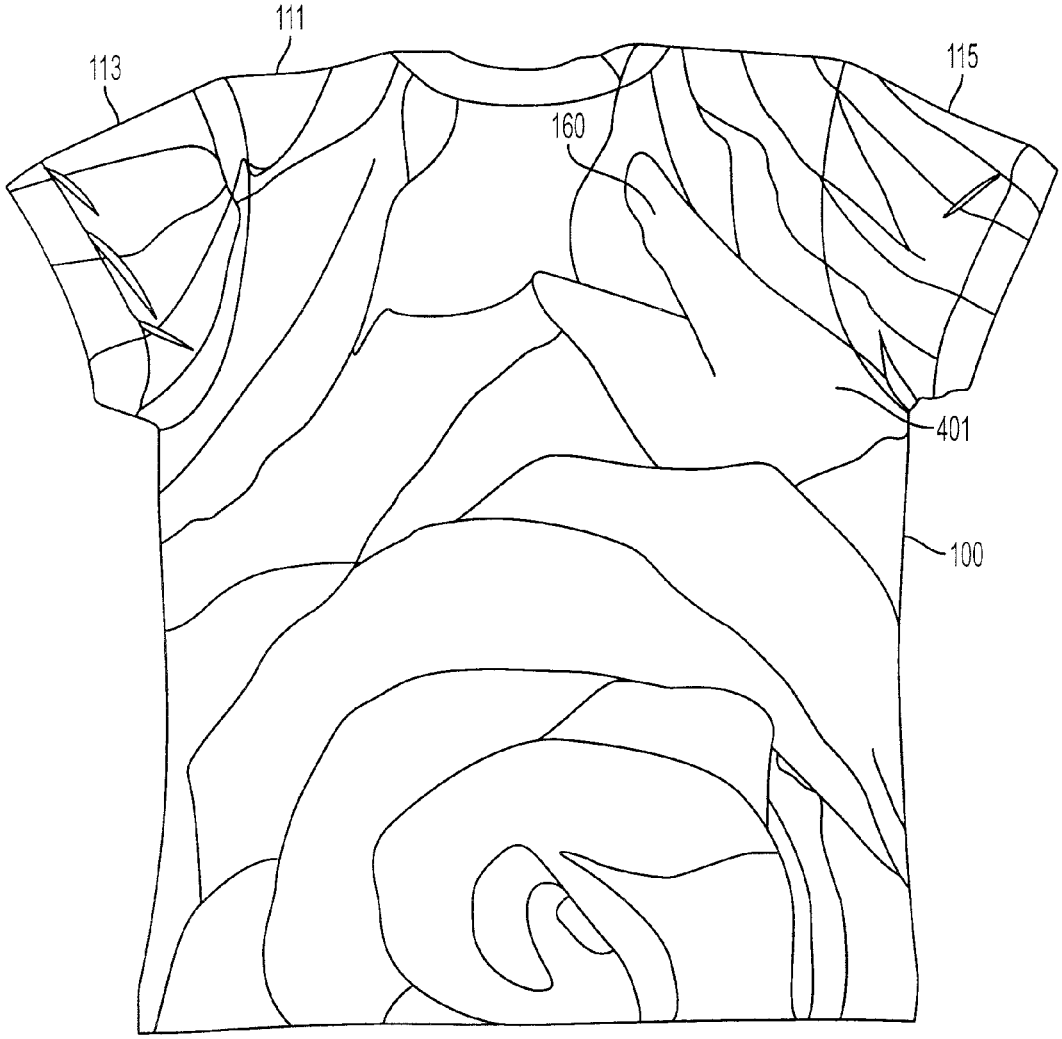
FIG. 2B is a back view of the T-shirt of FIG. 1 including an all-over print on the back.

FIGS. 2A and 2B provide for a front and back view, respectively, of an article of clothing, specifically a T-shirt (100) which has been printed using all-over printing of an embodiment of the present invention. In this embodiment, both the front (110) and back (160) of the T-shirt (100) have been printed. However, each of FIGS. 2A and 2B could represent a different shirt with all-over printing.

The image (201) used on the front of the shirt depicted in FIGS. 2A and 2B is a portion of a digital photograph of a child's birthday party. Such digital image (101) is again depicted in FIG. 3 in its native format which is rectangular. The image (101) includes a significant number and amount of colors and textures, and includes relatively complex subject matter. Further, the image (101) is one which is not prepared for shirt printing prior to arrival at the printing facility, but is instead generally taken for a different purpose. In this case it is a standard snapshot photograph of a special event.

Figure 3:
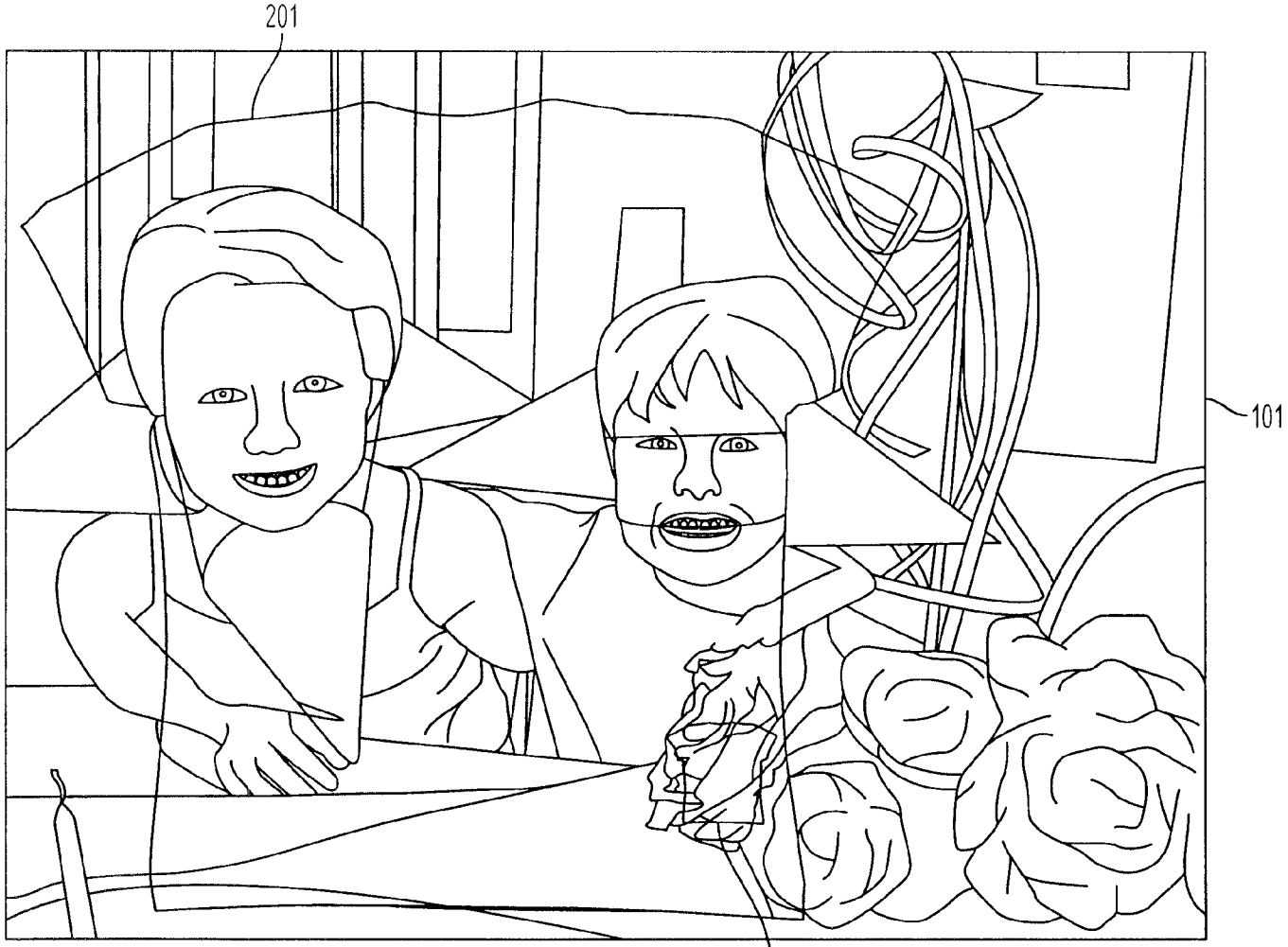
FIG. 3 shows the photographic image which is used to produce the shirt of FIGS. 2A and 2B indicating how the image is selected.

In FIGS. 2A and 2B, the front surface (110) of the T-shirt (100) has been printed with the portion (201) of the image (101) as indicated in FIG. 3 taken from the image (101). The image (101) is not centered on the underlying shirt (100) allowing a peripheral edge of the shirt (100) to be shown without printing as it was in FIG. 1. Instead, the portion (201) covers virtually the entire front surface (110) of the shirt (100) and covers more than one component. Specifically, the portion (201) is printed on the main body section (111) and on the arms (113) and (115). Printing also continues onto the collar (117) and cuffs (119) on the arms (113) and (115). it even carries onto the inside (121) of the back (160) of the shirt (100). It should be recognized that the portion (201) carries across seam lines in a relatively seamless fashion providing for the portion (201) of the image (101) to effectively cover the entire front surface (110) of the shirt (100).

In an embodiment, any surface of the article of clothing which can be defined as a flat surface may be entirely printed with an image as shown in FIGS. 2A and 2B. In effect, so long as a generally two dimensional surface can be described, it can be printed in an all-over fashion on that surface. In many articles of clothing, manufacturing techniques provide two generally well defined two-dimensional surfaces (which form the front and back) which are connected at the sides. Arms and other components can be flattened to also provide for a portion of such a surface Such flattening of clothing may be accomplished through traditional methods, such as, but not limited to, heat pressing (ironing or pressing).

Since the front (or back) of an article of clothing is effectively a two-dimensional surface when flattened it may be used as the surface of printing. However, one of ordinary skill in the art would understand that an article of clothing can easily be placed in other generally two-dimensional arrangements by simply being flattened in a different way. For example, the surface may be defined as the left or right side with the article compressed and flattened so as to give each side a relatively flat surface on which to print. On any selected flat surface, the present systems and methods allow for a two-dimensional image to be printed covering virtually the entirety of the flat surface and therefore carrying across multiple components of the article of clothing.

Figure 4:
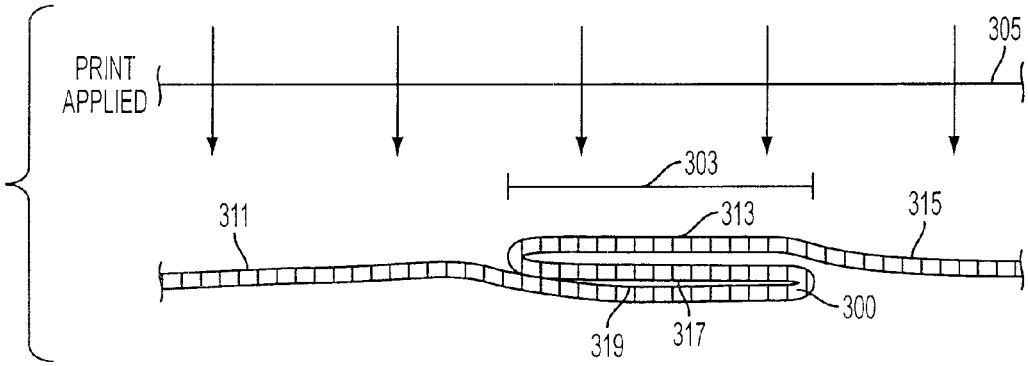
FIG. 4 shows a fabric fold and the two-dimensional printing surface.

Roundness associated with the arms as well as other inherent bunches or other structures can provide that any arrangement of the shirt which presents a 2-D surface for printing may include sections where a portion of the shirt fabric covers another portion. In an easy to understand exemplary embodiment, the front of a shirt will cover the fabric forming the back. In more detail, as a shirt is not a purely two-dimensional object, as it is compressed to form the 2-D printing surface, folds or similar places where fabric overlaps may become present. A detail view of such a fold is shown in FIG. 4. While the article of clothing (300) can be pressed flat, certain areas (303) may include more than two layers of fabric having become bunched up in the flattening process. When the article is returned to its three-dimensional form, such as by wearing, these folds (303) may unfold. As should be seen from FIG. 4, if a print is applied as shown generally at (305), the print will be transferred to surfaces (311), (313) and (315) but not to surfaces (317) or (319), which it could be if fold (303) was removed.

This, however, need not necessarily create a problem for the all-over printing. In an embodiment, the article of clothing (300) is flattened so as to provide the two-dimensional surface (311), (313) and (315), even if such surface includes sections which overlie each other (folds 303)). As the printing will only print the two-dimensional surface (311), (313) and (315), and will print the surface in its entirety, once the article (300) is returned to a three dimensional form, various folds (303) where the image is broken across a blank section of fabric may become visible. These folds (303) prevented printing of the material inside the fold (303). However, this is intended, in such an embodiment, to enhance the appearance of the article of clothing. Specifically, if one examines FIG. 1 the folds (303) generally disappear into the image as the broken image, being broken across relatively natural fold lines, will provide for a more natural printed appearance as lines of the underlying fabric color will be visible at points where the clothing will more naturally hang bunched. In effect, the unprinted portions will often not lie completely straight with an edge of the image leading to them disappearing into the image. Further, the eye may actually only see surfaces (311), (317) and part of (315) when the fabric is hanging naturally and the user will fill in the gaps on their own.

Since entire surfaces of the article are printed with a coherent image, there is generally no portion of the underlying shirt which is visible, except with regards to folds. In order to provide color coherency and further disguise folds, it will generally be the case that the underlying shirt color will be selected to compliment the image. For example, if the image included a lot of red or orange tones, an orange or pink colored shirt may be used. Since dying of shirts does not cover the underlying fabric, but instead provides for additional dying of the cloth, the cloth can take on facets of the coloration, but may still have some effect from the previous shirt color. This obviously depends on the color of shirt chosen, the type of material it is made out of, and the printing process.

It is generally preferred that dye sublimation of similar printing processes be used in the printing of articles of clothing as discussed herein. These processes allow for resultant articles that are more flexible and can reproduce more detailed images. Generally in dye sublimation, the more man-made fiber included in the shirt (e.g. if the shirt is made of 100% Spandex™ or Nylon™) the clearer the printing will be and the more the printing will change the color of the fabric. The more natural the shirt, the more color bleeding which can occur and the more blurred the image will be. Selection of a complementary color of shirt to the image will generally provide for improved printing. Specifically, if a color is chosen which relates to a large part of the image and is complementary thereto, the resulting image will often gain a slight color shift toward that particular color. For example, an image including a great deal of blue may have a slight blue shift if printed on a blue shirt.

The underlying color of the shirt can then be used to enhance the appearance of folds. For example, as the image now has shifted towards an underlying blue of the shirt. Portions of the shirt, such as folds, which are unprinted will generally appear to merely be a part of the image and will tend to enhance the line of the image over the shirt as the image is color shifted toward the color of the shirt. This is further due to the generally complementary nature of the color and perception of the whole image. As there is no major segregation of color, the eye will often see the fold as simply part of the complete image.

FIG. 2B shows the back (160) of the shirt (100) which is also printed in an all-over fashion with an image (401). In this case, the image (401) is a much smaller portion (501) of the front image (101) which has been greatly expanded to provide for a more patterned type of appearance. In particular, the back (160) of the shirt is detail of the petals of the flower portion (501) shown on the front side (110) of the shirt (100) which has been blown up to a size that it covers the entire back (160) of the shirt. While the back (160) of the shirt may be printed with any image, the printing with this type of patterned image provides for a couple of benefits in appearance for certain articles. Firstly, by having an image which does not have distinct shape to the human eye, the back (160) of the shirt (100) gains a more basic appearance and does not draw attention in the same fashion as the portion (201) on the front. Therefore, the front portion (201) has attention directed to it. However, at the same time, because both front (110) and back (160) of the shirt are printed with portions of the same image (101), the shirt has generally improved color coherence between the front (110) and the back (160) effectively the entire visible surface of the shirt (100) has been printed. This can make the shirt (100) look like a more coherent whole since there is no sudden cutoff where a complicated image suddenly becomes a solid single color shirt which can provide a visual disconnect. Instead, the entire shirt is infused with printed color and pattern. Secondly, Because of the brightness of the colors and the size of the image, rear printing with a portion of the image provides for a much more uniform shirt appearance by making the front and back color generally similar.

Figure 5:
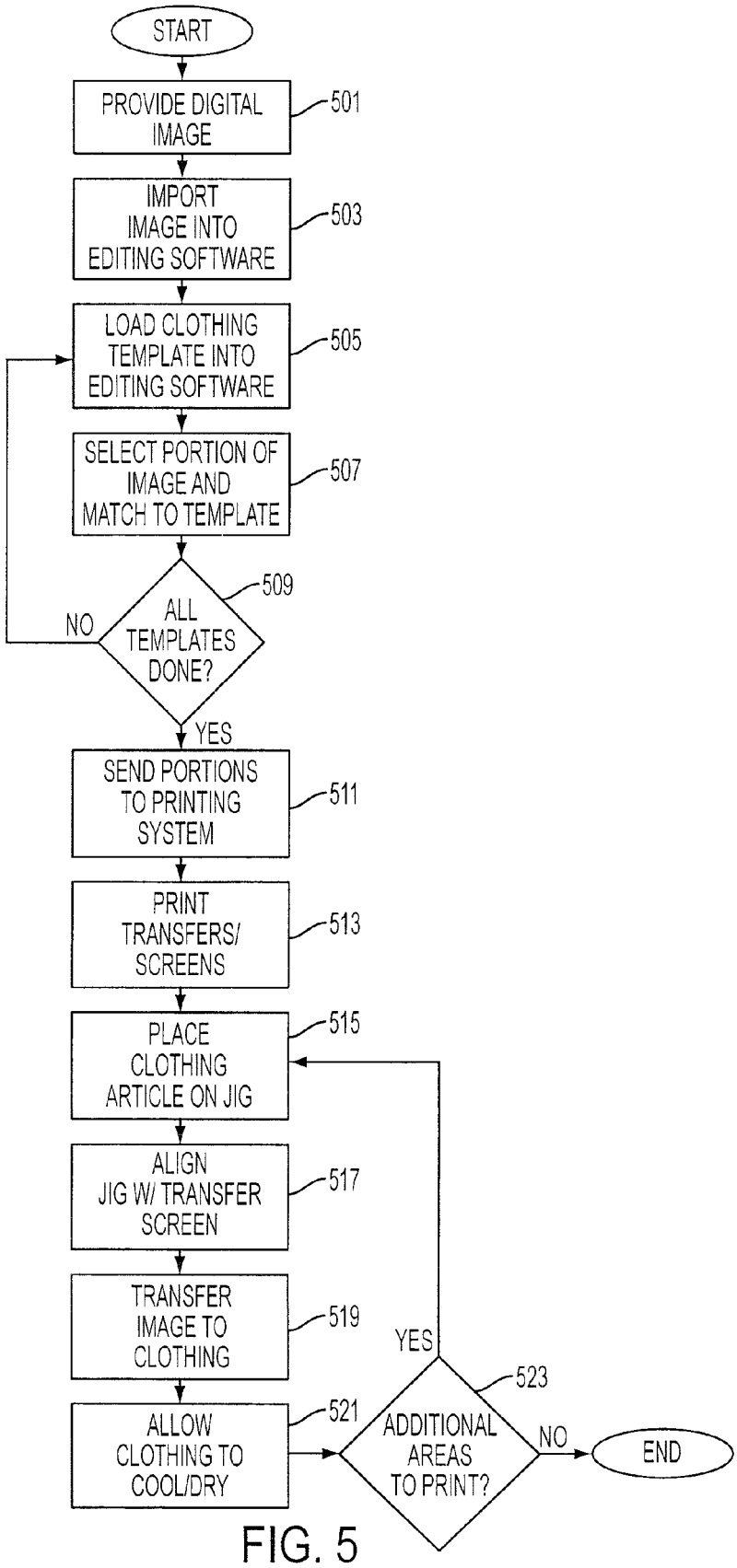
FIG. 5 is a flow chart showing the steps of transferring a photo to a T-shirt.

The all-over printing of an article of clothing is generally accomplished by a methodology such as that contemplated in FIG. 5 which provides for a flow chart of an exemplary method of how an article of clothing may be all-over printed with a user-provided image. In step (501) a digital image is provided which is to be printed on the article. In one embodiment, this image is a digital photo taken by the person desiring the article. The image may be of a personal event or subject, such as the case with the image (101) of FIG. 3 which shows a child's birthday party, or may be a more general picture such as a landscape or even artwork. While a photo will generally be the most common form of raw material, it is also possible to use a digitally created image such as a digital artwork.

Once the original subject matter is obtained, it is imported into some form of digital editing software such as Photoshop™ in step (503) which will allow the image to be manipulated to select the portion to be printed on the article. Generally, the initial image will not be shaped to correspond to the article on which it is to be printed, but will instead be a more standard size and a shape such as the rectangular 3×5 proportion image of a standard photograph. Once the image is in the computer, the user at the computer will load a clothing template in step (505). This template will be selected, generally from a library of such templates to correspond to the article of clothing upon which the image is to be printed. The template is proportioned to correspond to a particular brand, size, and style of clothing which is to be printed and represents the surface which will be available for printing, when the article is positioned on the jig (as discussed later in conjunction with FIG. 6). It, therefore, will include all relevant relative dimensions and indications of the shape and size of the article of clothing and will be correctly proportioned. In this case, it will be assumed the article of clothing is a short sleeved T-shirt.

Once both the image and template are loaded, the image file (or alternatively the template, so long as the proportions are maintained in the resizing) will then be resized in step (507) so as to provide the portion of the image to correspond to the template. This is shown in FIG. 3 with the two templates for portions (501) and (201) in place on the same photo. In this example, the templates (effectively (501) and (201)) are resized instead of the image (101). The resizing may include expanding the image or otherwise altering it to provide that the underlying image is larger than a first surface of the clothing to be printed. This will also involve artistic choices on the part of the designer. In particular, arms of the shirt can often be positioned in a number of different positions. This is particularly true on a long sleeve shirt. To print the arms, therefore, the user may be able to adjust their position on the template so as to provide them to be printed with the portion of the image they desire or alternatively may use a number of templates for the separate portions which are recombined to form the resulting image. In such an embodiment, the template may be adjustable or comprise separate pieces, but is effectively reformed once the image is selected.

In an alternative embodiment, the template comprises a number of separable portions or the image may be broken up so as to place desired portions on different portions of the template. Specifically, instead of the shirt template comprising the entire shirt, the shirt template may only comprise the front body and either a portion, or none of the sleeves. Instead, the sleeves may be a separate template. The sleeves can then be placed elsewhere on the image. Alternatively, the template may remain singular with the image being broken into pieces. The template image portion, in such an embodiment, is then recombined by the computer prior to making printouts in step (511) so that the printout portion will align with the assembled template and jigged articles of clothing.

Once the template has been setup for the image in step (507), additional templates may be done for additional portions of the shirt in step (509) This may comprise templates for the back, the sleeves, or other components which have not already had an image selected. It will generally be the case that the main subject of the image will be presented on one main surface of the article. The opposing surface will then generally be elements of the image selected to provide for additional printing. These may be parts of the image, such as a part that is repeated in the background (for instance if the back ground shows a forest, a portion of the forest may be selected to go onto the arms in a repetitive fashion. Alternatively, a portion of the image may be expanded or shrunk to a smaller size as between FIGS. 2A and 2B. This can provide for coloration swatches from a portion of the shirt. In the example of FIGS. 2A and 2B as discussed, the petals of the flower (201) located in the lower corner of the front portion (201) are expanded beyond the point of recognition as flower petals and are used as the back portion (501) in FIG. 2B.

As discussed, this use of image elements can provide a much more cohesive appearance to the shirt. Particularly when a photograph is used, it will be the case that colors are rarely solid and bright. Instead, colors will be more blended and gradual. By taking a portion of the image, the general arrangement of this gradation can be copied and recreated. This provides for a more flowing color appearance to the shirt.

In a still further embodiment, the image elements can provide for logical continuation of the image. For instance, the shirt may show an image of a line of people, such as silhouettes of bicycle riders going down a street. The image may then continue across various portions of the shirt. For instance the riders may extend down one arm, across the torso, and down the other arm. Alternatively, they may appear to wrap around the shirt from front to back, or may wrap in an endless loop around the torso.

Once the image and template have been edited and the portion to be printed has been selected and sized, it will be sent to a printing system in step (511). In a preferred embodiment, it will be ripped into a necessary printing system such as by using the Ergosoft RIP™ software. Once setup the data is sent to a printing process in step (513) which will print an image for transfer or to use as a screen for transfer.

It is generally preferred that the article be printed using dye sublimation inks and dye sublimation processes such as those generally discussed in U.S. Pat. No. 6,811,840, the entire disclosure of which is herein incorporated by reference. In a dye sublimation print process, the image will usually be printed onto appropriate paper in a mirror format and will be printed at the appropriate size to cover the entire article to be printed. For example, a "small" sized article will have a printing that is smaller than a "large" sized article. As the image is printed proportional and shaped to cover the article on the two-dimensional surface in step (513), the print can then be taken to the printing area. In step (515) the article is provided, which serves to place the article in the format expected from the printing. Generally, the articles will be mounted on a jig (603) which will place it in an arrangement that presents a two-dimensional surface corresponding, in shape and proportion, to the template and therefore is aligned with the print to be transferred.

Figure 6A:
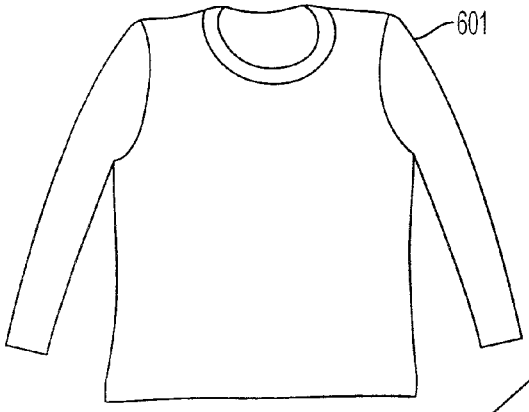
FIG. 6 shows a long-sleeved shirt (FIG. 6A), jig (FIG. 6B), the long sleeved shirt on the jig (FIG. 6C), and an indication of the template used in conjunction with this jig (and shirt) (FIG. 6D). Comparison of the component FIGS. show how the jig holds the shirt in the template position.
Figure 6B:
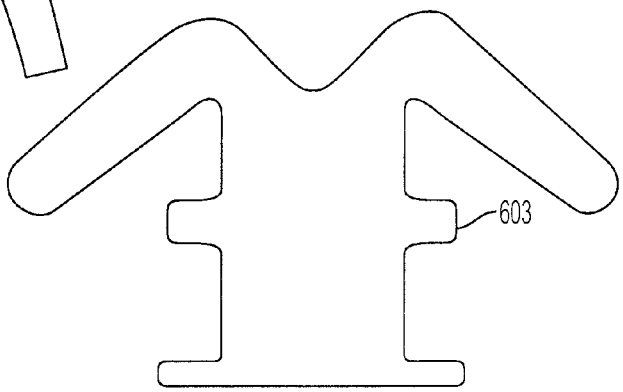
Figure 6C:
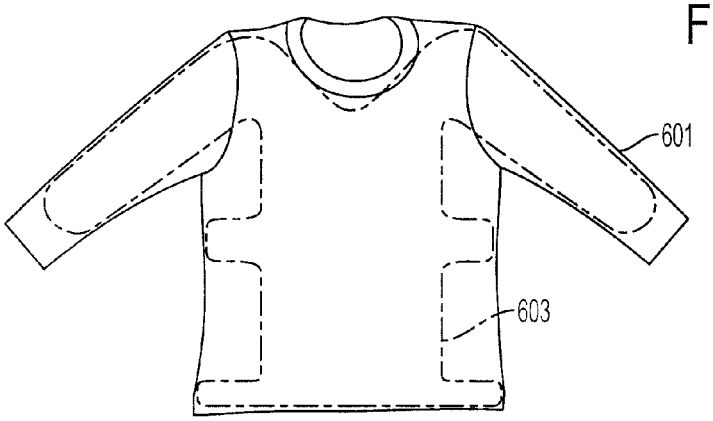
Figure 6D:
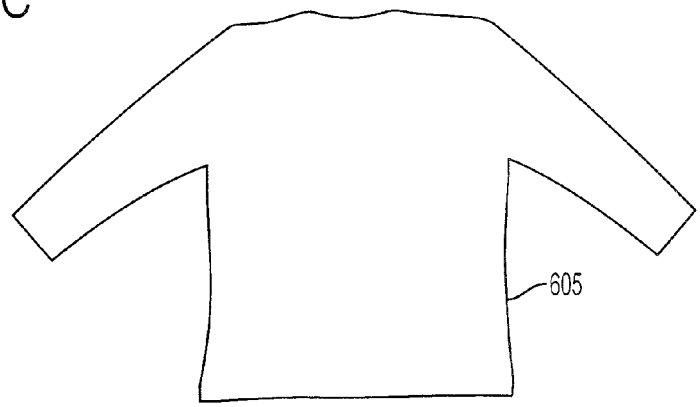

In an embodiment, the jig comprises a frame or other structure upon which the article is placed. The jig is sized and shaped to hold the article so that the selected surface formed from the article corresponds to the template. An example of this is generally shown in FIG. 6. In FIG. 6, the shirt (601) when simply laid flat as shown in FIG. 6A, does not necessarily correspond to the template shape (605), shown in FIG. 6D, as the arms are in an incorrect position, even though the surface is the same. The jig (603) of FIG. 6B provides for the shirt to be placed thereon and positions the shirt (601) as shown in FIG. 6C to correspond with the template (605). In step (517) the print is aligned with the article and jig and the print is transferred from the paper to the article as is understood by those of ordinary skill in the art depending on printing format in step (519).

The use of a jig (603) is particularly useful in the all-over printing process. Because the application of heat and/or pressure is generally necessary to transfer the inks to the article, it is necessary that the article be maintained in a fixed shape during the entire process, and the shape correspond to the selected template in a consistent, repeatable way, it is desirable that there be a device for easily placing the article in the desired position. It is well known that the application of heat will generally flatten a fabric (as is done with ironing) making it smoother. However if any portion of the shirt is folded, it will result in the folds being tightly pressed together. In the resulting printing process, the material inside the fold will not be printed. Therefore it is desirable that the location of folds be generally expected and relatively limited in most cases so that their presence will enhance, and not detract from the image. For this reason, the jig (603) will generally be designed to maintain the article in a generally stable position which is proportional to the template used. Further, portions of the article need to be positioned so as to align with the template prior to the image being applied to make sure that image portions (such as those on the arms) are correctly aligned and printed. Therefore, an interface which provides relatively consistent placement of the jig to the print is also beneficial.

The jig (603) is generally designed to place the article in essentially the same position as it is in the template. From this respect, it therefore allows the surface of the article corresponding to the template to be printed in one single print process. Specifically, each of the portions (201) and (501) of the image may be printed without multiple printings of the article. In a still further embodiment, the two opposing surfaces may be printed simultaneously by printing both sides of the jig with prints at the same time. The jig may therefore position arms and other portions of the shirt very specifically so that they align with the expected position of the template.

The jigged shirt is aligned with the master print or screen, and the image is transferred in conventional fashion in step (519). In one embodiment, the alignment is mechanical so as to minimize human error. Once the image transfer process is completed, the shirt is allowed to cool or dry in step (521) and is effectively completed. At this time, if there are additional areas to be printed (523), the process may be repeated placing the shirt on a new jig, or simply flipping it over depending on the image.

Once completed the shirt will generally be inspected. In the event that there are unsightly folds or other irregularities from an unexpected position on the jig, or for example, an undesirable interaction of the inks with the color of the article, the shirt may be failed in inspection and discarded repeating the printing process with a completely new article. Alternatively, a fold or other unexpected unprinted section may actually be printed with another pattern. For instance, if it is determined that somehow a one inch wide section under one arm was missed in the printing process, it can be possible to define a new template representing the portion to be printed, and take a portion of the image to fill the hole using the same technique as was used to print the article as a whole. This can give the article additional uniqueness and can also decrease the number of waste articles that are incorrectly printed.

While the systems, methods, and clothing articles discussed above have focused on the use of the process with shirts, it should be recognized that any type of pre-constructed piece of clothing may be printed in a similar fashion. One can print shorts, socks, gloves, hats or anything else where a template can be created.

In an alternative embodiment the ability to print only one side of a surface of a fold can be used to produce a wholly unique design. In particular, the clothing can be printed so that an area which is to be folded over when the garment is to be worn, can be printed with the fold already made to provide a broken image over the unfolded article. For example, in current fashion it is popular for women to fold over the waistband of shorts so that the elastic is effectively on the outside of the short. This makes the waistband somewhat thicker and also shortens the length of the shorts slightly. Further, in the past, it has been popular to modify clothing using other similar folds. For instance, tying or rolling up the lower portion of a T-shirt to expose the belly button has been popular in recent years. Also folding the sleeves of shirt upward to expose more of the arm has been a popular fashion trend at different times, as has been turning the color of a collared shirt upwards, or pushing up the sleeves of a long sleeved shirt.

In all these various fashion trends (and surely in many more to come) the inclusion of a fold (or lack of fold) in the pre-constructed article is part of the way the clothing is worn. In an alternative embodiment therefore, the articles of clothing can be printed on the expectation of the fold being made or removed. For instance, a pair of women's shorts can be printed with the waistband already turned down. Therefore when the waistband is turned down, the printed image is actually completed encouraging the shorts to be worn in this manner.

The methodology of purposeful folds can also be used to provide for a wholly new type of printing. For example, an article may be purposefully crumpled up on the jig, and the pressed to provide a front surface including a large number of folds of various positions. The article is then printed and when the shirt is unfolded, the image includes a "shatter" effect by positioning the folds. Such a jig and template can even position folds to radiate from a point near the center of the shirt to enhance the resultant appearance. A similar type of thing may be performed on an arm providing for a shattered effect when the aim is fully extended, but a more cohesive appearance when the arm is pushed up.

One of ordinary skill would see that the above listing of effects and appearances are only some of those that may be created by the ability to print all over a shirt in a cohesive fashion and while the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A method of printing an article of clothing, the method comprising;

providing a pre-constructed article of clothing; said pre-constructed article of clothing comprising at least two individually cut fabric components that have been previously assembled together making said pre-constructed article of clothing ready to wear;

providing a digital image to be placed on said pre-constructed article of clothing;

forming a computer template, the template being proportioned to be the same size and shape as the pre-constructed article of clothing in a particular arrangement of its components;

arranging at least a portion of the digital image so as to completely cover the computer template;

using the computer template to generate a print master; and using said print master to transfer said image to said pre-constructed article of clothing;

wherein, said portion of said digital image extends across at least two of said at least two components.

2. The method of claim 1 wherein said article of clothing is a shirt.

3. The method of claim 1 wherein said article of clothing is a hat.

4. The method of claim 1 wherein said article of clothing is either pants or shorts.

5. The method of claim 1 wherein said using comprises performing dye sublimation.

6. The method of claim 1 further comprising:

having a jig, the jig holding the article of clothing in a particular arrangement where the article has a two-dimensional surface shaped similarly to and proportional to said computer template; and mounting said article of clothing on said jig.

7. The article of claim 1 wherein said digital image comprises a digital photograph.

8. A method of printing a pre-constructed article of clothing, the method comprising;

providing a pre-constructed article of clothing on which a two-dimensional surface is defined, said pre-constructed article of clothing comprising at least two individually cut fabric components that have been previously assembled together so said pre-constructed article of clothing is ready to wear;

providing a digital image to be placed on said two-dimensional surface;

forming a computer template, the template being proportioned to be the same size and shape as said two-dimensional surface;

arranging said pre-constructed article of clothing so as to present said two-dimensional surface;

formatting at least a portion of the digital image so as to completely cover the computer template, said portion defining a coherent image; and transferring said image to said two-dimensional surface in such a fashion that said coherent image retains its coherency when said pre-constructed article of clothing is worn.

9. The method of claim 8 wherein said article of clothing is a shirt.

10. The method of claim 8 wherein said article of clothing is a hat.

11. The method of claim 8 wherein said article of clothing is either pants or shorts.

12. The method of claim 8 wherein said transferring comprises performing dye sublimation.

13. The method of claim 8 wherein said coherency is obtained when said article of clothing is folded in accordance with a current style of wearing such article of clothing.

14. The method of claim 8 further comprising aligning said two-dimensional surface with said print master.

15. The method of claim 14 wherein said aligning occurs automatically.

16. The article of claim 8 wherein said digital image comprises a digital photograph.

17. The method of claim 8 further comprising:

having a jig, said arranging comprising placing said article of clothing on said jig; and maintaining said article of clothing on said jig throughout said transferring.

18. The method of claim 17 further comprising aligning said jig with said print master.

19. The method of claim 18 wherein said aligning occurs automatically.

* * * * *